US006595585B2

(12) United States Patent
Mundell

(10) Patent No.: US 6,595,585 B2
(45) Date of Patent: Jul. 22, 2003

(54) LUMBAR SUPPORT DEVICE

(75) Inventor: Donald David Mundell, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/120,983

(22) Filed: Apr. 11, 2002

(65) Prior Publication Data

US 2002/0149245 A1 Oct. 17, 2002

Related U.S. Application Data

(63) Continuation-in-part of application No. 09/832,692, filed on Apr. 11, 2001, now Pat. No. 6,402,246.

(51) Int. Cl.[7] ..... A47C 7/46
(52) U.S. Cl. ..... 297/284.4
(58) Field of Search ..... 297/284.1, 284.4

(56) References Cited

U.S. PATENT DOCUMENTS

| | | | | | |
|---|---|---|---|---|---|
| 3,095,188 | A | | 6/1963 | Giese | 267/89 |
| 3,241,879 | A | | 3/1966 | Castello et al. | |
| 3,378,299 | A | | 4/1968 | Sandor | |
| 4,019,777 | A | | 4/1977 | Hayashi | |
| 4,231,615 | A | | 11/1980 | Griffiths | |
| 4,316,631 | A | * | 2/1982 | Lenz et al. | 297/284.1 |
| 4,627,661 | A | | 12/1986 | Rönnhult et al. | |
| 4,715,653 | A | | 12/1987 | Hattori et al. | |
| 5,022,709 | A | | 6/1991 | Marchino | |
| 5,299,851 | A | | 4/1994 | Lin | 297/284.5 |
| 5,335,965 | A | | 8/1994 | Sessini | 297/284.4 |
| 5,468,048 | A | | 11/1995 | Clemens et al. | 297/284.4 |
| 5,474,358 | A | * | 12/1995 | Maeyaert | 297/284.7 |
| 5,651,584 | A | * | 7/1997 | Chenot et al. | 297/284.4 |
| 5,823,620 | A | | 10/1998 | LeCaz | 297/284.4 |
| 5,913,569 | A | | 6/1999 | Klingler | 297/284.4 |
| 5,954,399 | A | | 9/1999 | Hong | 297/284.4 |
| 5,988,745 | A | * | 11/1999 | Deceuninck | 297/284.4 |
| 6,036,265 | A | * | 3/2000 | Cosentino | 297/284.4 |

FOREIGN PATENT DOCUMENTS

| | | | |
|---|---|---|---|
| GB | 2342287 | 4/2000 | B60N/2/44 |

* cited by examiner

*Primary Examiner*—Peter R. Brown
(74) *Attorney, Agent, or Firm*—Dennis J M Donahue, III; Husch & Eppenberger LLC; Grant D. Kang

(57) ABSTRACT

A lumbar support device has a seat frame, a pair of brackets connected to the seat frame, a spring assembly connected to the pair of brackets in such a manner as to form a center section traversing the seat frame and a pair of cantilevered ends on opposite sides of the center section, and an actuator assembly operatively connecting the cantilevered ends. The pair of brackets respectively provide a pair of fulcrums about which the cantilevered ends can rotate. In operation, the actuator assembly moves the cantilevered ends of the spring assembly to bow the center portion. The lumbar support device may also have a single cantilevered end.

21 Claims, 6 Drawing Sheets

LUMBAR SUPPORT DEVICE

CROSS-REFERENCE TO RELATED APPLICATIONS

This application is a continuation-in-part of application Ser. No. 09/832,692, filed Apr. 11, 2001 now U.S. Pat. No. 6,402,246.

STATEMENT REGARDING FEDERALLY SPONSORED RESEARCH OR DEVELOPMENT

Not Applicable.

FIELD OF THE INVENTION

The present invention relates generally to lumbar support devices. More particularly, the present invention relates to lumbar support devices that are capable of changing shape, especially curvature in the lumbar region.

BACKGROUND OF THE INVENTION

Lumbar support devices have been integrated into seats to change their shape, thereby allowing each occupant to adjust the support provided by the seat. The curvature of these devices is traditionally adjustable so that an occupant can operate the device to push the seat forward towards the occupant's spinal column in the lumbar region. It is generally known to change the curvature of a lumbar support device using an actuator assembly that moves a support structure, such as a sinusoidal spring element. It is also well known to provide an actuator assembly that is either manually operated, using a handle or knob, or power assisted, using a drive motor and control switches. Increased curvature is usually accomplished by moving the support structure forward into the lumbar region, rotating sections of the support structure into the lumbar region, or bowing the support structure out into the lumbar region.

SUMMARY OF THE INVENTION

One aspect of the present invention relates to a strap lumbar device having a seat frame, a pair of brackets connected to the seat frame, a spring assembly connected to the pair of brackets in such a manner as to form a center section traversing the seat frame and a pair of cantilevered ends on opposite sides of the center section, and an actuator assembly operatively connecting the cantilevered ends. The pair of brackets respectively provide a pair of fulcrums about which the cantilevered ends can rotate.

In the preferred embodiment, the spring assembly has two integrally-formed, sinusoidal spring elements attached by a connector, and the center section of the spring assembly has a recessed portion. In other embodiments of the invention, a single sinusoidal spring has only one cantilevered end that rotates about a bracket, and a leaf spring is cantilevered about a pair of coil springs. The lumbar support device can be oriented horizontally or vertically in the seat frame, and the orientation of the cantilevered ends can be reversed.

In operation, the fulcrums allow the cantilevered ends to function as levers. The actuator assembly moves the levers which rotate about the fulcrums and bow the center section. The fulcrums are located between the distal end of the levers and the center section of the spring to stop the lever from sliding in the bracket and force the lever to rotate about the bracket.

Another aspect of the invention pertains to a lumbar support device comprising first and second mounts, a main body, and an actuator assembly. The mounts are spaced apart from each other and the main body has opposite end margins that are operatively connected to the mounts. The main body consists essentially of wire, and further comprises an intermediate portion that extends along the longitudinal trajectory of the main body between the first and second mounts. A point along the longitudinal trajectory defines first and second sub-portions of the intermediate portion and the wire is shaped and configured such that the first sub-portion has an average bending stiffness that is less than that of the second sub-portion. Additionally, the first end margin of the main body comprises a lever arm that extends in a cantilever manner and an actuator assembly is operatively connected to the main body via the lever arm. The actuator assembly is configured and adapted to induce a bending moment in the first end margin of the main body via the lever arm such that the longitudinal trajectory of the main body is selectively bendable between first and second positions. Due at least partially to the difference between the average bending stiffness of the first sub-portion and the average bending stiffness of the second sub-portion, the amount of curvature change of the longitudinal trajectory along the first sub-portion is greater than the curvature change of the longitudinal trajectory along the second sub-portion. In turn, this results in the curvature of the first sub-portion increases substantially more than that of the second sub-portion in response to the bending moment provided by the actuator assembly. Thus, the first sub-portion of the main body tends to bulge more than the second sub-portion when the longitudinal trajectory of the main body is selectively bent between first and second positions, thereby providing the main body with a desirable shape in an efficient manner. Furthermore, the fact that main body has such properties, and yet consists essentially of wire, allows the lumbar support device to be manufactured with low costs and simplifies the assembly of the lumbar support device.

In yet another aspect of the invention, a lumbar support device comprises first and second mounts, a main body, and an actuator assembly. The mounts are spaced apart from each other and the main body has opposite end margins that are operatively connected to the mounts. The first end margin comprises a lever arm that is formed by the wire that forms the main body. The lever arm extends in a cantilever manner and the actuator assembly is operatively connected to the main body via the lever arm in a manner such that the actuator assembly is capable of inducing an increasing bending moment to the first end margin. By forming the lever arm out of the wire that also forms the main body, the assembly procedure of the lumbar support device is simplified and the costs of the lumbar support device is substantially reduced.

In yet another aspect of the invention, a method of adjusting the contour of a seatback of a seat assembly is disclosed. The method comprises providing a seat assembly having a rigid seat frame and a seatback and operatively attaching first and second mounts to the seat frame in a manner such that the first and second mounts are spaced apart from each other adjacent the seatback. The method further comprises providing a main body that consists essentially of wire for supporting the seatback and for providing the seatback with a contour. The main body has first and second end margins and the wire is shaped and configured such that a first portion of the main body that extends along one of two contiguous halves of the longitudinal trajectory of the main body has a bending stiffness that is substantially less than a bending stiffness of a second portion of the main body that extends along the other of the two halves. The method yet further comprises operatively connecting the first end margin of the main body to the first mount and the second end margin to the second mount in a manner such that the main body supports the seatback and operatively connecting an actuator assembly to the main body. The actuator assembly is configured and adapted to selectively induce an increasing bending moment to at least one of the end margins of the main body such that the longitudinal trajectory of the main body increases in curvature in response to the increasing bending moment. The method yet further comprises adjusting the curvature of the main body from a first position to a second position via inducing an increasing bending moment to the at least one of the first and second end margins of the main body using the actuator assembly. The adjusting of the curvature of the main body causes the first portion of the main body to increase in curvature a greater amount than that of the second portion of the main body as a result of the bending stiffness of the first portion of the main body being substantially less than that of the second portion of the main body. This results in the contour of the seatback being adjusted in a desirable manner.

It is a purpose of the present invention to provide a lumbar support device that is simple and affordable to manufacture.

It is a further purpose of the present invention to provide a mechanically simplified lumbar support device that has a thin profile when flat.

Further advantages of the present invention will be apparent from the description below with reference to the accompanying drawings in which like numbers indicate like elements.

DETAILED DESCRIPTION OF THE INVENTION

Figure 1:
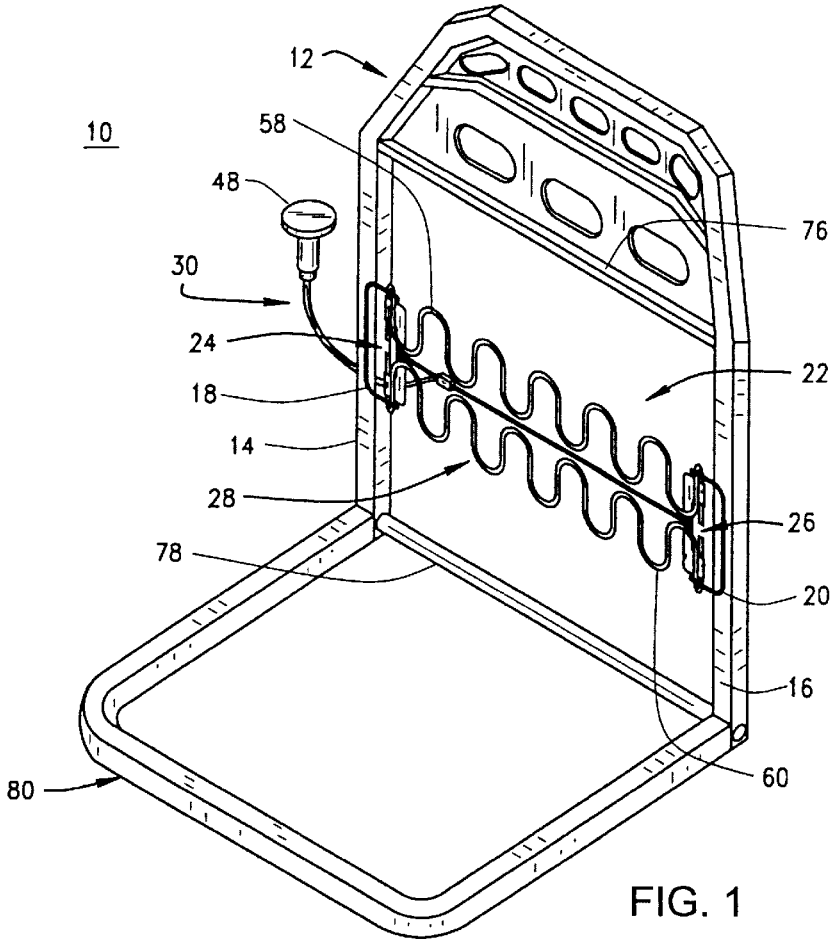
FIG. 1 illustrates the preferred embodiment of the lumbar support device installed in a frame.
Figure 2:
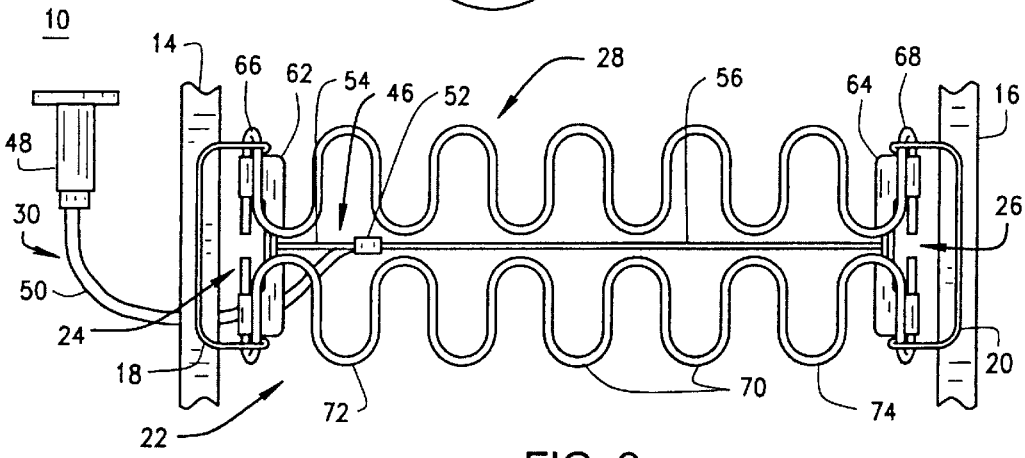
FIG. 2 illustrates a front view of the preferred embodiment of the lumbar support device.
Figure 3:
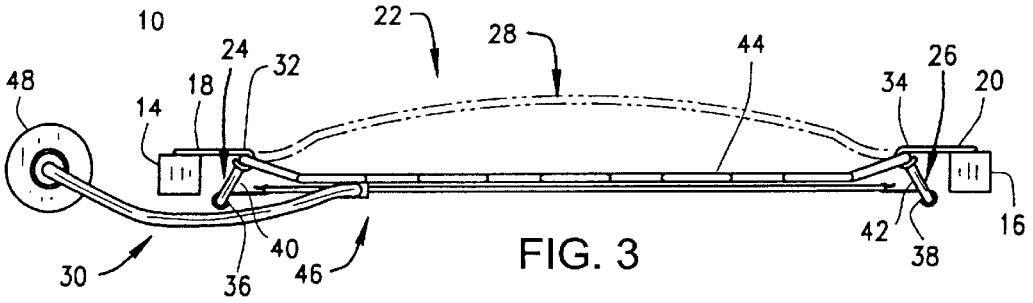
FIG. 3 illustrates a top view of the preferred embodiment of the lumbar support device.

As shown in FIGS. 1, 2 and 3, the preferred embodiment of a lumbar support device 10 generally includes a seat frame 12 having a first side 14 and a second side 16, a first bracket 18 and a second bracket 20 respectively fixed to the first and second sides 14, 16, a spring assembly 22 connected to the pair of brackets 18, 20 in such a manner as to respectively form first and second cantilevered ends 24, 26 on opposite sides of a center section 28, and an actuator assembly 30 operatively connecting the cantilevered ends 24, 26. The first and second brackets have first and second fulcrums 32, 34, respectively. The first fulcrum 32 is located proximately to the first side 14 and located distally from the second side 16, and the second fulcrum 34 is located proximately to the second side 16 and located distally from the first side 14.

In the preferred embodiment, the center section 28 of the spring assembly 22 is integrally formed with the first and second cantilevered ends 24, 26. The first and second cantilevered ends 24, 26 are rotatably connected to and cantilevered about the first and second brackets 18, 20, respectively, and the center section 28 traverses the seat frame between the first and second brackets 18, 20. The first and second cantilevered ends 24, 26 have first and second distal ends 36, 38, respectively, such that the first and second cantilevered ends 24, 26 define first and second levers 40, 42, respectively. The first lever 40 extends from the first fulcrum 32 to the first distal end 36, and the second lever 42 extends from the second fulcrum 34 to the second distal end 38. The actuator assembly 30 connects the first and second distal ends 36, 38 and operates to force the distal ends 36, 38 of the respective levers 40, 42 toward each other, thereby rotating the levers 40, 42 about the first and second fulcrums 32, 34, respectively, and bowing the center section 28. In the drawings, broken lines illustrate the actuated position.

The center section 28 has a recessed portion 44 that reduces the thickness 46 of the center section 28 when not bowed. The brackets 18, 20 are rigidly attached to the seat frame 12 and the cantilevered ends 24, 26 are attached to their respective fulcrums 18, 20 such that they are only able to rotate. The fulcrums 18, 20 stop the respective cantilevered ends 24, 26 from sliding. Without the recessed portion 44, a straight center section (see FIGS. 5 & 6) would have the same length as a straight line between the brackets 18, 20 and forcing curvature in the straight center section would bow the center section, requiring the center section to extend and requiring the actuator assembly to provide additional force to produce both curvature and extension. With the recessed portion 44, the center section 28 has a greater length than the straight line between the brackets. Therefore, the recessed portion 44 reduces the force needed by the actuator assembly 30 to bow the center section 28 because less force, if any, is necessary to extend the center section 28.

The actuator assembly 30 preferably includes a bowden cable assembly 46 and an actuator 48. The bowden cable assembly 46 has a sheathed section 50, a base 52, a rod 54 and an unsheathed section 56. The rod 54 and the unsheathed section 56 respectively link the distal ends 36, 38 of the levers 40, 42. The base 52 holds the rod 54 and one end of the sheathed section 50, and the other end of the sheathed section 50 is connected to the actuator 48. To force the distal ends 36, 38 of the respective levers 40, 42 toward each other, the actuator 48 transmits a tractive force through the bowden cable assembly 46 to the distal ends 36, 38. Although the preferred embodiment uses the tractive actuator assembly 30, other types of actuator assemblies, including those supplying pulsive forces may also be used. For example, as one type of pulsive actuator assembly, screw actuators (not shown) could engage threaded rods (not shown) to push the distal ends 36, 38 of the respective levers 40, 42 toward each other.

Figure 4:
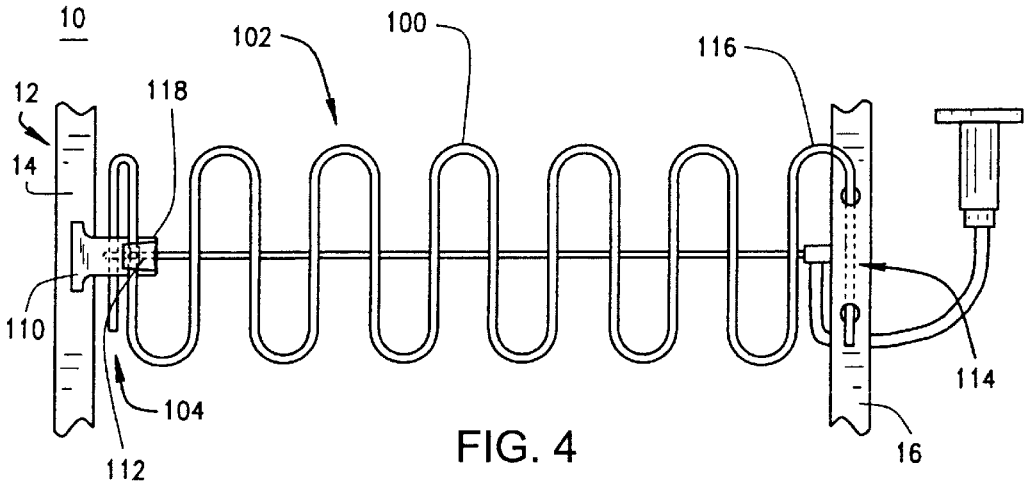
FIG. 4 illustrates a front view of a first alternative embodiment of the lumbar support device according to the present invention.
Figure 5:
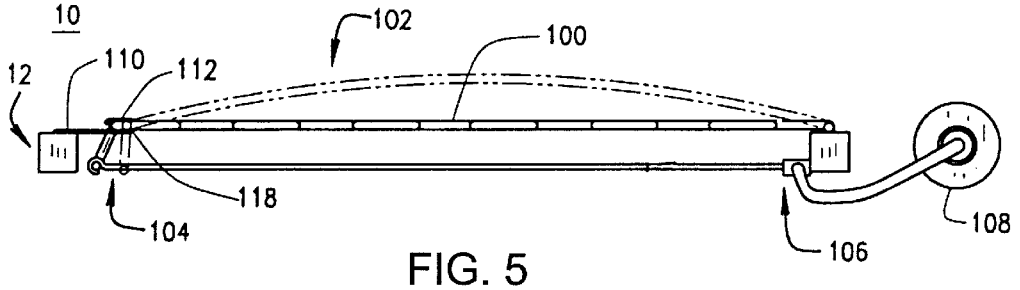
FIG. 5 illustrates a top view of the first alternative embodiment of the lumbar support device illustrated in FIG. 4.
Figure 6:
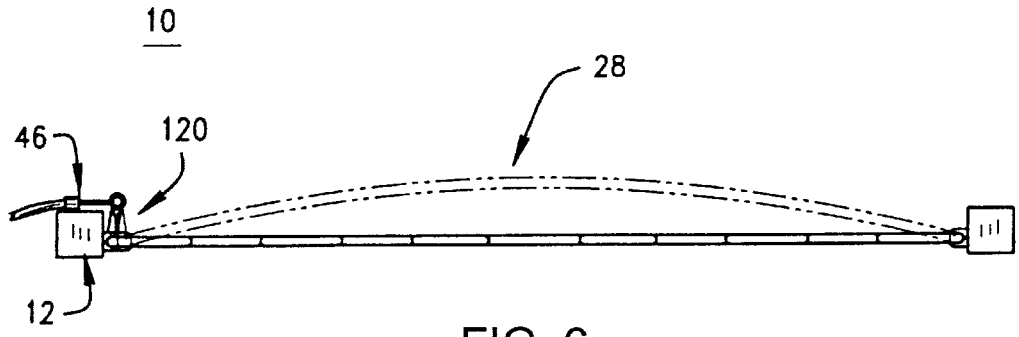
FIG. 6 illustrates a second alternative embodiment of the lumbar support device according to the present invention.

The spring assembly 22 is preferably formed from a pair of sinusoidal springs 58, 60 that are similarly attached to the brackets 18, 20. For each of the sinusoidal springs 58, 60, the center section 28 is integrally formed with the cantilevered ends 24, 26 from a single wire bent into the sinuous shape. The springs 58, 60 are held together by a pair of connectors 62, 64, but according to the present invention, either one of the pair, sinusoidal spring 58 or sinusoidal spring 60, could be used alone, as illustrated in FIGS. 4, 5 and 6. In the preferred embodiment, a first loop 66 is rotatably connected to and cantilevered about the first bracket 18, thereby defining the first cantilevered end 24, and a last loop 68 is rotatably connected to and cantilevered about the second bracket 20, thereby defining the second cantilevered end 26. The center section 28 has a plurality of loops 70 between the pair of brackets 18, 20, including a second loop 72 integrally formed with the first loop 66 and a second-to-last loop 74 integrally formed with the last loop 68.

As illustrated in the preferred embodiment, the first side 14 is generally opposite the second side 16, the first side 14 being on the right side of the seat frame 12 and the second side 16 being on the left side of the seat frame 12. The seat frame 12 also has a top side 76 and a bottom side 78 that can alternatively be used as the first side 14 and the second side 16, respectively. The present invention can also be mounted in reverse orientations, and the present invention may be attached to the bottom portion 80 of the seat frame 12.

As illustrated in FIGS. 1, 2 and 3, the first and second brackets 18, 20 are directly and rigidly attached to the first and second sides 14, 16, respectively. Such a fixed connection can be made by welding the brackets to the seat frame, by mounting the brackets with hardware, by integrally forming the brackets in the seat frame, or by using other methods to make a direct, rigid connection. Additionally, the connection between the brackets 18, 20 and the seat frame 12 does not necessarily need to be direct or rigid. An example of an indirect connection would be where an additional structural element is interposed between the brackets 18, 20 and the seat frame 12, such as a coil spring (not shown), in which case the connection would neither be direct nor rigid. Alternatively, the brackets 18, 20 may be directly connected to the seat frame 12 and the coil springs may be interposed between the fulcrums 32, 34 and the respective levers 40, 42. An example of a direct connection that is not rigid could be a rod having a loop (not shown) rotatably attached to the seat frame, such as the fulcrums 32, 34 of the brackets 18, 20, or a coil spring attached at one end to the seat frame and attached at its opposite end to the lever (see FIG. 7). Finally, the brackets can traverse the seat frame 12 in a direction substantially perpendicular to the center section 28 and still provide first and second fulcrums 32, 34 that are proximate and distal from the respective sides 14, 16. For example, in the configuration where the center section 28 horizontally traverses (between left and right) the seat frame 12, the brackets can be a pair of generally parallel rods (not shown) on opposite sides of the frame that are attached to the frame at the top side and the bottom side. With such a configuration, the rod traversing the frame on the left side could provide a fulcrum proximate to the left side and the rod traversing the frame on the right side could provide a fulcrum proximate to the right side.

An alternative embodiment of the lumbar support device 10 is illustrated in FIGS. 4 and 5. A sinusoidal spring 100 is similar to the spring assembly 22 described in the preferred embodiment, but the center section 102 traverses straight across the seat frame 12 without any recessed portion. The spring 100 only has one lever 104 at the first side 14 of the seat frame 12, and a bowden cable assembly 106 connects the lever 104 with an actuator 108. A bracket 110 is rigidly attached to the seat frame 12 at the first side 14. The bracket 110 has a hook 112 to hold the lever 104, thereby allowing the lever 104 to slide somewhat as well as rotate in the hook 112. An integral bracket 114 is formed in the second side 16 of the seat frame 12, and the second end 116 of the spring 100 is rotatably attached to the integral bracket 114.

As discussed above, without any recessed portion, the center section 102 has the same length as a straight line between the brackets 110, 116. The bracket 110 with the hook 112 allows the actuator 108 to bow the center section 102 with less force than would be necessary if the lever 104 is only permitted to rotate. For example, replacing the bracket 110 with a bracket with a loop, as shown in the preferred embodiment, would prevent the lever 104 from any sliding or translation, and the actuator 108 would force both curvature and extension in the center section 102. Although the lever 104 is allowed to slide in the bracket 114, sliding is limited because the bracket 114 has a fulcrum 118 that stops the lever 104 from sliding and forces the lever 104 to rotate.

Figure 7:
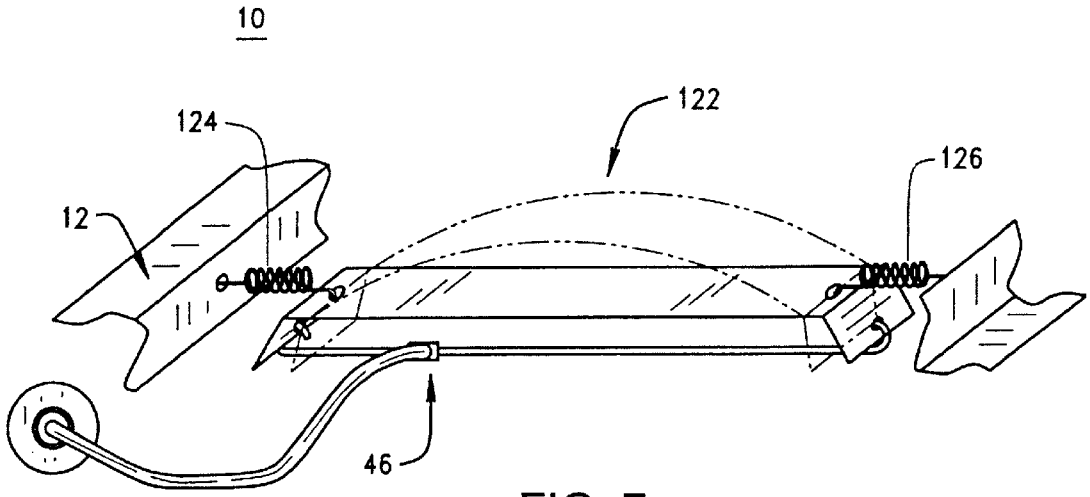
FIG. 7 illustrates a third alternative embodiment of the lumbar support device according to the present invention.

FIGS. 6 and 7 illustrate other alternative embodiments of the present invention for the lumbar support device 10. FIG. 6 shows a lever 120 that is oriented opposite from the other embodiments. As with any of the embodiments, if the spring is formed with a curvature shape, the lever can be used in reverse to flatten the spring, in which case a tractive actuator assembly could be replaced with a pulsive actuator assembly and vice-versa. FIG. 7 shows a leaf spring 122 connected to the seat frame 12 through a pair of coil springs 124, 126 which serve as brackets. Although the preferred embodiment illustrated in FIGS. 1, 2 and 3 has a spring assembly 22 with pair of sinusoidal springs 58, 60 and a pair of cantilevered ends 24, 26, it is evident from the alternative embodiments that the lumbar support device 10 may have a single spring and a single cantilevered end, and that different types of springs will work. In each embodiment of the lumbar support device 10 discussed above, including the preferred embodiment, every fulcrum is preferably located between the distal end of the lever and the center section of the spring.

Figure 8:
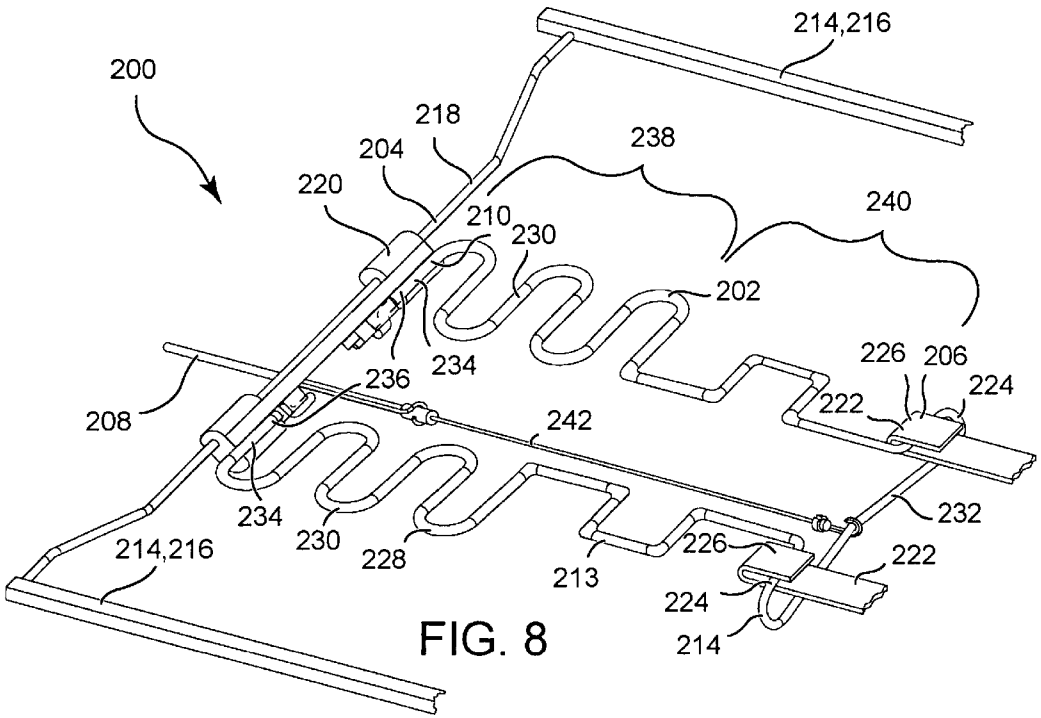
FIG. 8 illustrates a fourth alternative embodiment of a lumbar support device installed in a frame.
Figure 9:
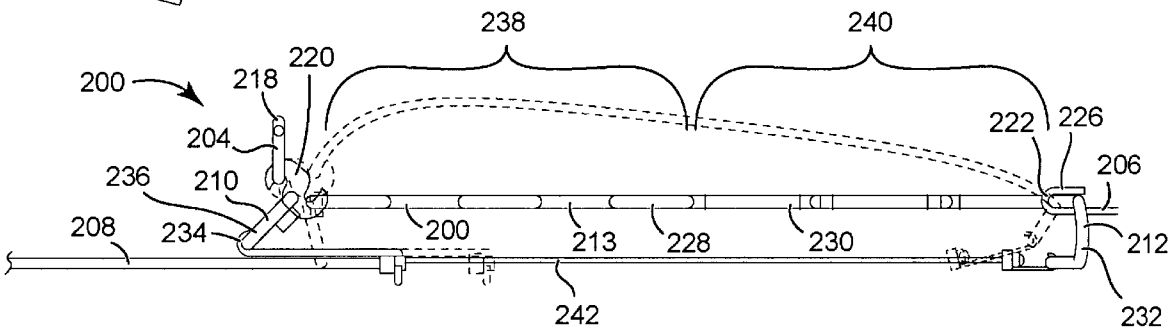
FIG. 9 illustrates a side view of the fourth alternative embodiment of the lumbar support device illustrated in FIG. 8.

FIGS. 8 and 9 illustrate a fourth alternative embodiment of a lumbar support device 200 of the present invention. The lumbar support device 200 of the fourth embodiment comprises a main body 202 that is similar to the spring assembly described above, mounts 204, 206, and an actuator assembly 208. The main body 202 has first 210 and second 212 end margins and is formed essentially of wire. The wire is preferably metal spring wire of the type known in the art for use in seat assemblies. The first end margin 210 of the main body is preferably connected to the first mount 204, 206 and the second end margin 212 is preferably connected to the second mount such that an intermediate portion 213 of the main body extends longitudinally therebetween. As shown in FIG. 8, the mounts 204, 206 of the lumbar support device 200 are preferably attached to a seat frame 214 in a manner such that they are spaced vertically apart from each other and where they will position the main body 202 adjacent the seatback (not shown) of the seat in which the lumbar support device is installed. As such, the longitudinal dimension of main body 202 of the lumbar support device 200 extends generally parallel to the sides 216 of the seat frame 214.

The first mount 204 of the lumbar support device 200 of the fourth embodiment preferably comprises a single wire mount 218 that traverses the width of seat frame 214 from one of the seat frame sides 216 to the other. The first mount 204 also preferably comprises a connector 220 formed of glass reinforced nylon. The connector 220 is pivotally connected to the wire mount 218 and to the first end margin 210 of the main body 202 in a manner such that the first end margin of the main body can pivot about an axis that is generally parallel to the wire mount 218 and perpendicular to the longitudinal direction of the main body 202. The second mount 206 of the lumbar support device 200 preferably comprises a pair of brackets 222 that connect opposite side portions 224 of the second end margin 212 of the main body 202 to the sides 216 or top of the seat frame 214. Each of such brackets 222 are similar to the bracket 110 of the alternative embodiment of the lumbar support device 10 shown in FIG. 4 and discussed above and, similarly, each comprises a hook 226. Like the bracket 110 of the alternative embodiment of the lumbar support device 10 shown in FIG. 4, the hook 226 holds the respective side portion 224 of the second end margin 212 of the main body 202 in a manner that allows the second end margin to slide a given distance toward the first end margin 210 relative to the bracket and thereafter only permits rotation.

The main body 202 is preferably formed from a single sinuate wire 228 that preferably extends longitudinally from the first end margin 210 of the main body, to the second end margin 212 of the main body, and back to the first end margin in a manner such that two undulating springs 230 are formed traversing the intermediate portion 213 of the main body 202. The two undulating springs 230 can be generally referred to as two intermediate portions of the main body 202. A lever arm 232 is formed by the sinuate wire 228 at the second end margin 212 of the main body 202 as the wire loops back toward the first end margin 210. As best shown in FIG. 9, the lever arm 232 at the second end margin 212 of the main body 202 cantilevers from the main body 202 and creates a moment-arm about an axis that extends through each of the hooks 226 of the brackets 222 of the second mount 206. In a similar manner, the opposite ends 234 of the sinuate wire 228 turn abruptly at the first end margin 210 of the main body 202 and together form a pair of lever arms 236 that cantilever therefrom, such that each of said lever arms forms a moment-arm with respect to the center axis of the wire mount 218 of the first mount 204. The lever arms 236 of the first end margin 210 are preferably joined by and held spaced apart by the connector 220 of the first mount 204. As shown, the lever arms 236 at the first end margin 210 is preferably dimensioned slightly longer than the lever arm 232 at second end margin 212 of the of the main body 202.

An important aspect of the main body 202 of the fourth embodiment of the lumbar support device 200 lies in the configuration of the undulating springs 230. Unlike the embodiments discussed above, the sinuous pattern of the trajectory of each of the undulating springs 230 of the fourth embodiment is not uniform as each such spring 230 longitudinally traverses the intermediate portion 213 of the main body 202. In particular, the intermediate portion 213 of the main body 202 is theoretically divisible a some point along its longitudinal trajectory into first 238 and second 240 longitudinally extending sub-portions that have different bending stiffnesses. The difference in bending stiffnesses is preferably achieved by changing the sinuous pattern of each undulating spring 230 as it longitudinally traverses the intermediate portion 213 of the main body. In particular sinuous pattern of each of the undulating springs 230 within the first sub-portion 238 preferably has a greater average frequency and a greater average amplitude than it averages throughout the second sub-portion 240. As a direct result of such, it should be appreciated by one skilled in the art that the first sub-portion 238 of the intermediate portion 213 has a bending stiffness that is substantially less than that of the second sub-portion 240, thereby making the first sub-portion more easy to flex than the second sub-portion. This difference in flexibility impacts the shape of the longitudinal trajectory of the main body 202 when subjected to bending stresses and is utilized, as discussed below, to bow the main body in a non-symmetrical, preferred manner.

The actuator assembly 208 of the lumbar support device 200 of the fourth embodiment is preferably similar to that of the preferred embodiment shown in FIGS. 1–3 and the specific type and arrangement of the actuator assembly is not of particular importance to this embodiment. It should be appreciated that the actuator assembly 208 preferably comprises a bowden cable 242 that is configured and adapted to selectively generate a tractive force between objects. As shown in most clearly in FIG. 9, the actuator assembly 208 is operatively connected to the lever arms 232, 236 at each of the end margins 210, 212 of the main body 202 where, when activated, the actuator assembly will act to force the levers toward each other.

In operation, lumbar support device of the fourth embodiment generally functions in a manner similar to the lumbar support device 10 shown in FIGS. 4 and 5. In a first position, as shown in solid lines in FIG. 9, the longitudinal trajectory of the intermediate portion 213 of the main member 202 extends substantially strait. Additionally, when in the first position, the second end margin 212 of the main body 202 is free to slide a given distance in a direction toward the first end margin 210 relative to the brackets 222 of the second mount 206 due to the configuration of the hooks 226 as described above in reference to FIGS. 4 and 5. When desired, the actuator assembly 208 can be activated to generate a tractive force between the lever arms 232, 236 of the end margins 210, 212 of the main body 202. Similar to the other embodiments discussed above, the tractive force on lever arms 232, 236 induces a bending moment in each of the end margins 210, 212 which, in turn, causes longitudinal trajectory of the intermediate portion 213 to bend to a second position in which it bows perpendicular outward relative to its lateral width, as shown in dashed lines in FIG. 9.

Unlike the previously described embodiments of lumber support devices, the main body 202 of the lumbar support device 200 of the fourth embodiment bows in a non-symmetric manner. This non-symmetric bowing is due, at least in part, to the configuration of the intermediate portion 213, as described above, that results in the bending stiffness of its first sub-portion being substantially less than that of the second sub-portion 240. It should be appreciated that, as a result of such stiffnesses, for any given induced bending moment, the longitudinal trajectory of the intermediate portion 213 of the main body 202 throughout its first sub-portion 238 will increase in a greater average curvature than that of the second sub-potion 240. Thus, the longitudinal trajectory of the first sub-portion 213 will therefore tend to bulge further outwardly throughout the first sub-portion 238 as compared to the second sub-portion 240. Although the bending moment induced throughout the main body 202 via the actuator assembly 208 is not necessarily constant, it should also be appreciated that the differences in bending stiffness between the first and second sub-portions 238, 240 at least partially contributes to any such bulging. It should also be appreciated that the main body 202 is preferably oriented in a manner such that its first longitudinal half 238 is positioned below its second half 240 with respect to the seat frame 214 such that the first half of the main body is positioned adjacent a person's lumber region when such a person rest against the seat. Thus, the uneven bulging or bowing of the first sub-portion 238 of the intermediate portion 213 of the main body 202 compared to the second sub-portion 240 is desirable for providing additional lumbar support when needed.

Figure 10:
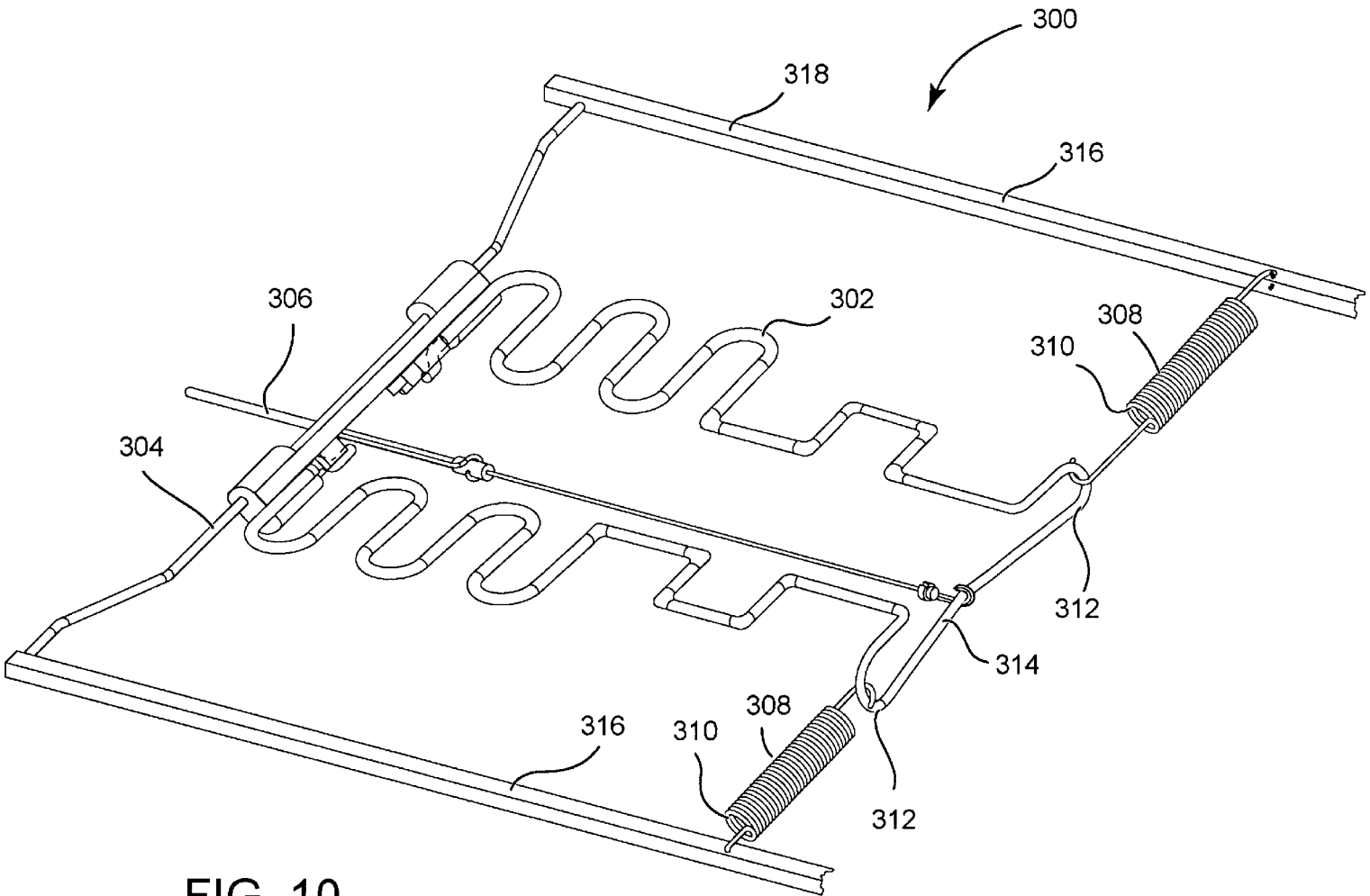
FIG. 10 illustrates a fifth alternative embodiment of a lumbar support device according to the present invention.

The lumbar support device 300 of the fifth embodiment shown in FIG. 10 is substantially identical to the lumbar support device 200 of the fourth embodiment and utilizes an identical main body 302, first mount 304, and actuator assembly 306. However, second mount 308 of the lumber support device 300 of the fifth embodiment comprises a pair of coil tension springs 310 to operatively connect the opposite side portions 312 of the second end margin 314 of the main body 302 to the sides 316 of the seat frame 318 in which the device is placed.

In operation, the coil tension springs 310 operate in manner similar to the brackets 222 of the lumbar support device 200 of the fourth embodiment in that they allow the second end margin 314 of the main body 302 to translate toward the first end margin 320 of the main body as main body is bowed via the actuator assembly 306. However, unlike the brackets 222 of the lumbar support device 200 of the fourth embodiment, the coil tension springs 310 allow such motion by resiliently stretching and therefore no relative sliding between the coil tension springs and the main body 302 occurs. Thus, the lumbar support device 302 of the fifth embodiment has less tendency to wear or bind during use and is simplified as compared to the lumbar support device 202 of the fourth embodiment discussed above.

Figure 11:
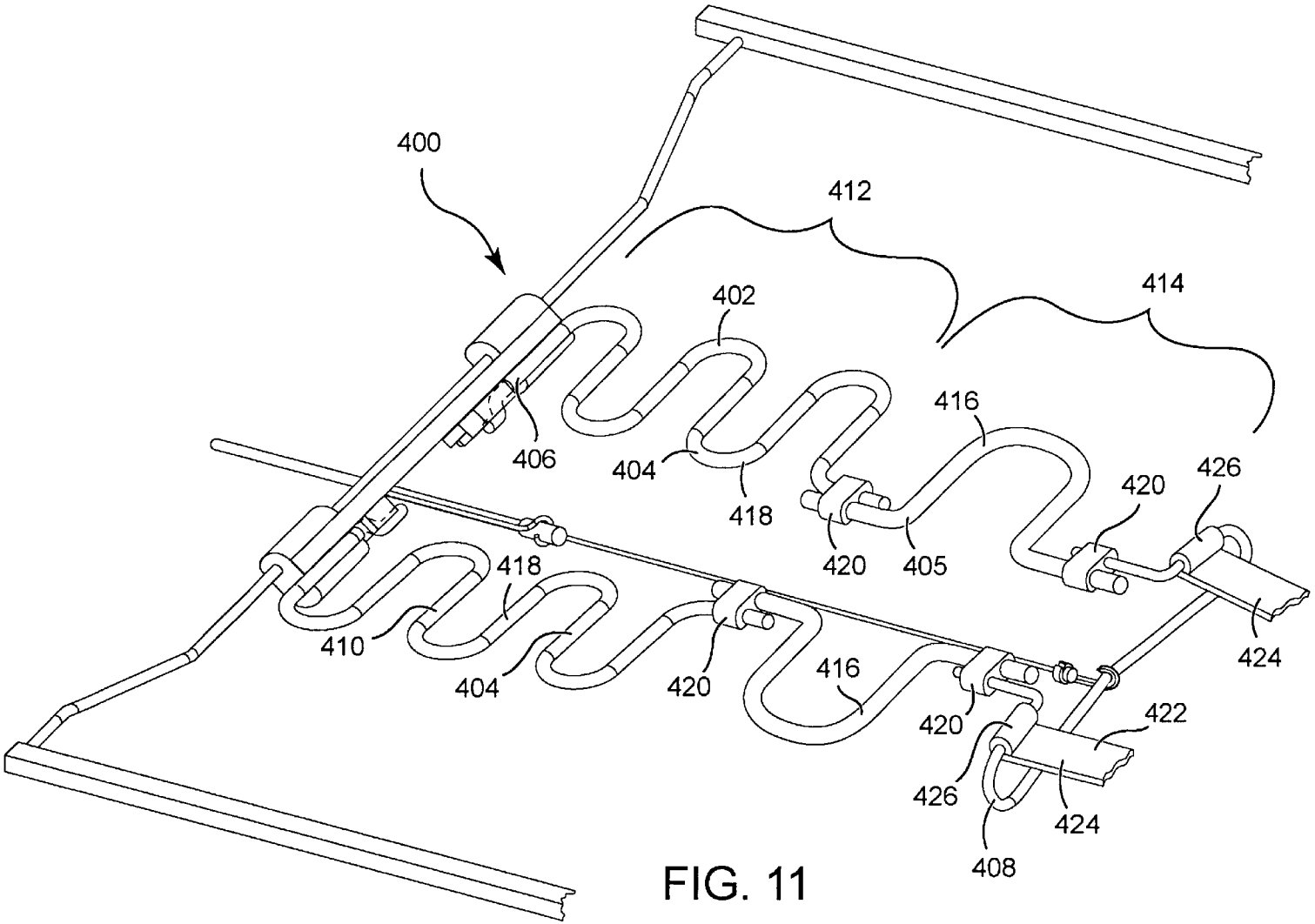
FIG. 11 illustrates a sixth alternative embodiment of a lumbar support device according to the present invention.

FIG. 11 illustrates yet another embodiment of a lumbar support device 400. This sixth embodiment of a lumber support device 400 is configured and adapted to achieve the same results as the fourth and fifth embodiments discussed above, but does so using a differently configure main body 402. Like the main bodies 202, 302 of the fourth and fifth embodiments, the main body 402 of the lumber support device 400 of the sixth embodiment comprises a pair of undulating springs 404 that longitudinally traverse the intermediate portion 405 of the main body between first and second end margins 406, 408 of the main body. However, unlike the lumbar support devices 200, 300 of the fourth and fifth embodiments, the wire 410 forming each of the undulating springs 404 changes gauges as it extends longitudinally in a manner such that the average diameter of the wire throughout a first sub-portion 412 of the intermediate portion 405 is less than average diameter of the wire throughout a second sub-portion 414 of the intermediate portion. As shown in FIG. 11, this can be done by crimping a lager diameter wire 416 section to a smaller diameter wire section 418 via annular bands 420. Alternatively, different gauge wire sections can be butt-welded end to end to form a continuous wire of varying gauge (not shown), or other suitable techniques know in the art can be utilized to achieve the same result, such as initially forming the wire of different gauges along its longitudinal trajectory or by using wire sections having different material properties.

As a result of comprising more than one gauge of wire as discussed above, the first sub-portion 412 of the intermediate portion 405 of the main body 402 has significantly less bending stiffness than that of the second sub-portion 414, without necessarily having a different sinuate pattern. Thus, it should be appreciated that the first sub-portion 412 of the intermediate portion 405 of the main body 402 will have a tendency to increase in curvature more than the second sub-portion 414 as the main body is subjected to bending moments.

Another difference between the lumbar support device 400 of the sixth embodiment as compared to the lumbar support devices 200, 300 of the fourth and fifth embodiments is the second mount 422. The second mount 422 of the lumbar support device 400 of the sixth embodiment comprises a pair of brackets 424 having closed loop ends 426 that allow only pivotal movement between the second end margin 408 of the main body 402 and such brackets, similar to the brackets shown in FIGS. 1–3 and discussed above.

Aside from the differences discussed above, the lumbar support device 400 of the sixth embodiment is identical to the lumbar support devices 200, 300 of the fourth and fifth embodiments and it should therefore be appreciated that the main body 402 of the lumbar support device of this sixth embodiment operates much like the main body 202, 302 of the fourth and fifth embodiments and achieves a similarly desirable uneven flexing when actuated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while a sinusoidal spring and a leaf spring are particularly illustrated for the present invention, it will be evident to those skilled in the art that other types of integrally formed springs or combination of springs, such as a composite spring made with a leaf spring and a sinusoidal spring, or a combination using a coil spring, may be interchanged with the illustrated springs. Thus, the breadth and scope of the present invention should not be limited by any of the above-described exemplary embodiments, but should be defined only in accordance with the following claims appended hereto and their equivalents.

What is claimed is:

1. A lumbar support device comprising:

first and second mounts that are spaced apart from each other;

a main body consisting essentially of wire, the main body extending along a longitudinal trajectory between opposite first and second longitudinal end margins, the first longitudinal end margin being operatively connected to the first mount and the second end margin being operatively connected to the second mount, the main body further comprising an intermediate portion that extends along the longitudinal trajectory between the first mount and the second mount, wherein the intermediate portion further comprises first and second sub-portions, the wire being configured such that the first sub-portion has an average bending stiffness that is less than an average bending stiffness of the second sub-portion, and wherein the second end margin comprises a lever arm that extends in a cantilever manner relative to the second mount; and an actuator assembly operatively connected to the main body via the lever arm, the actuator assembly being configured and adapted to induce a bending moment in the second end margin of the main body via the lever arm such that the longitudinal trajectory of the main body is selectively bendable between first and second positions, the longitudinal trajectory along each of the first and second sub-portions having a curvature change when the longitudinal trajectory is bent between the first and second positions via the actuator, the curvature change of the longitudinal trajectory along the first sub-portion being greater than the curvature change of the longitudinal trajectory along the second sub-portion according to the difference in the average bending stiffness between the first sub-portion and the second sub-portion.

2. A lumbar support device in accordance with claim 1, wherein the wire comprises at least one continuous wire that extends from the first end margin of the main body to the second end margin, the at least one continuous wire being formed in a manner such that that it has a sinuate shape as the continuous wire extends along the longitudinal trajectory of the main body.

3. A lumbar support device in accordance with claim 2, wherein the at least one continuous wire has a generally constant diameter.

4. A lumbar support device in accordance with claim 2, wherein the sinuate shape has a greater average frequency and a greater average amplitude throughout the first sub-portion of the intermediate portion than the sinuate shape in the second sub-portion.

5. A lumbar support device in accordance with claim 2, wherein the wire consists of the one continuous wire.

6. A lumbar support device in accordance with claim 2, wherein the continuous wire further comprises at least two intermediate portions between the first and second end margins.

7. A lumbar support device in accordance with claim 6, wherein the lever arm is formed by the continuous wire between the two intermediate portions.

8. A lumbar support device in accordance with claim 7, wherein the lever arm is formed between the second sub-portion of the two intermediate portions.

9. A lumbar support device in accordance with claim 7, wherein the first end margin further comprises a first end lever arm formed by the continuous wire, the first end lever arm extending in a cantilever manner relative to the first mount, the actuator assembly being operatively connected to the main body via the first end lever arm in a manner such that the actuator assembly is capable of inducing a bending moment to the first end margin of the main body via the first end lever arm.

10. A lumbar support device in accordance with claim 9, wherein the second mount further comprises a pair of coil springs.

11. A lumbar support device in accordance with claim 1, wherein the wire comprises a larger diameter wire in the first sub-portion and a smaller diameter wire in the second sub-portion.

12. A lumbar support device in accordance with claim 1, wherein the second mount is configured such that the second end margin of the main body is permitted to translate relative to the second mount in a direction toward the first mount when the longitudinal trajectory is initially bent via the actuator.

13. A lumbar support device in accordance with claim 1; further comprising:

a connector pivotally connected to the first mount and to the first end margin of the main body in a manner such that the first end margin of the main body can pivot about an axis that is generally parallel to the first mount.

14. A lumbar support device in accordance with claim 1; further comprising:

a seat frame having a first side and a second side, wherein the first mount operatively connects the first end margin of the main body to the first side of the seat frame and the second mount operatively connects the second end margin of the main body to the second side of the seat frame.

15. A lumbar support device comprising:

first and second mounts that are spaced apart from each other;

a main body consisting essentially of wire, the main body extending along a longitudinal trajectory between longitudinally opposite first and second end margins of the main body, the first end margin of the main body being operatively connected to the first mount and the second end margin being operatively connected to the second mount, the first end margin further comprising a first end lever arm, the first end lever arm extending in a cantilever manner relative to the first mount;

a connector pivotally connected to the first mount and to the first end lever arm of the main body in a manner such that the first end margin of the main body can pivot about an axis that is generally parallel to the first mount; and an actuator assembly operatively connected to the main body through the connector, the actuator assembly being configured and adapted to selectively induce an increasing bending moment in the first end margin of the main body through the connector such that the longitudinal trajectory of the main body increases in curvature in response to the increasing bending moment.

16. A lumbar support device in accordance with claim 15, wherein the wire comprises at least one continuous wire that extends from the first end margin of the main body to the second end margin of the main body, the at least one continuous wire being formed in a manner such that that it has a sinuate shape as it extends along the longitudinal trajectory of the main body and forms a lever arm at the second end margin, the lever arm extending in a cantilever manner relative to the second mount and the actuator assembly being configured and adapted to induce a bending moment in the second end margin of the main body via the lever arm.

17. A lumbar support device in accordance with claim 16, wherein the continuous wire further comprises at least two intermediate portions between the first and second end margins and the second mount comprises a pair of coil springs.

18. A lumbar support device in accordance with claim 16, wherein the main body further comprises an intermediate portion that extends along the longitudinal trajectory between the first mount and the second mount, the longitudinal trajectory has a point that lies between the first and second mounts, the point defines first and second sub-portions of the intermediate portion that extend in longitudinally opposite directions from the point and that together constitute the entirety of the intermediate portion, the sinuate shape of the at least one continuous wire is such that the first sub-portion has an average bending stiffness that is less than an average bending stiffness of the second sub-portion, the first sub-portion of the main body separating the first end margin from the second sub-portion as the main body extends along the longitudinal trajectory.

19. A lumbar support device in accordance with claim 15, wherein the second mount is configured such that the second end margin of the main body is permitted to translate relative to the second mount in a direction toward the first mount when the main body initially increases in curvature.

20. A lumbar support device in accordance with claim 15, further comprising:

a seat frame having a first side and a second side, wherein the first mount operatively connects the first end margin of the main body to the first side of the seat frame and the second mount operatively connects the second end margin of the main body to the second side of the seat frame.

21. A method of adjusting a contour of a seat assembly, the method comprising:

providing a seat assembly having a rigid seat frame and a seatback, the seatback being configured and adapted to support a person's back when the person is seated on the seat assembly;

operatively attaching first and second mounts to the seat frame in a manner such that the first and second mounts are spaced apart from each other;

providing a main body consisting essentially of wire for supporting the seatback and for providing the seatback with a contour, the main body extending along a longitudinal trajectory between longitudinally opposite first and second end margins of the main body, the wire being configured such that a first portion of the main body that extends along one of two contiguous halves of the longitudinal trajectory of the main body has a bending stiffness that is less than a bending stiffness of a second portion of the main body that extends along the other of the two halves of the longitudinal trajectory;

operatively connecting the first end margin of the main body to the first mount and the second end margin to the second mount in a manner such that the seat frame supports the main body in a position adjacent the seatback;

operatively connecting an actuator assembly to the main body, the actuator assembly being configured and adapted to selectively induce an increasing bending moment to at least one of the first and second end margins of the main body such that the longitudinal trajectory of the main body resiliently increases in curvature in response to the increasing bending moment;

adjusting the curvature of the main body from a first position to a second position via inducing an increasing bending moment to the at least one of the first and second end margins of the main body using the actuator assembly, the adjusting of the curvature of the main body causing the first portion of the main body to increase in curvature a greater amount than that of the second portion of the main body as a result of the bending stiffness of the first portion of the main body being less than that of the second portion of the main body, the contour of the seatback thereby being also being adjusted.

* * * * *